US005588326A

United States Patent [19]

Stroter et al.

[11] Patent Number: 5,588,326

[45] Date of Patent: Dec. 31, 1996

[54] FEEDING DEVICE FOR PARTS TO BE MOUNTED

[75] Inventors: Hermann Stroter, Wuppertal; Frank Obst, Haan; Rolf Kamps, Wuppertal; Holger Reich; Rainer Siegemund, both of Wuppertal, all of Germany

[73] Assignee: Stocko Fasteners GmbH, Wuppertal, Germany

[21] Appl. No.: 404,646

[22] Filed: Mar. 15, 1995

[30] Foreign Application Priority Data

Mar. 15, 1994 [DE] Germany ..... 44 08 694.6

[51] Int. Cl.[6] ..... A41H 37/00; B21J 15/10

[52] U.S. Cl. ..... 74/50; 227/37; 227/155

[58] Field of Search ..... 74/50, 104; 227/32, 227/37, 141, 155; 29/243.53, 243.54, 813; 403/83, 104, 106

[56] References Cited

U.S. PATENT DOCUMENTS

| | | | |
|---|---|---|---|
| 1,349,661 | 8/1920 | Buhl | 74/50 |
| 1,373,500 | 4/1921 | Glass . | |
| 1,967,662 | 7/1934 | Clark | 227/32 |
| 2,559,278 | 7/1951 | Catlin et al. . | |
| 2,735,567 | 2/1956 | Carpinella . | |
| 2,939,145 | 6/1960 | Lundeberg . | |
| 3,069,688 | 12/1962 | Heil . | |
| 4,122,988 | 10/1978 | Casutt | 29/243.54 X |
| 4,199,094 | 4/1980 | Birkhofer et al. | 227/37 |
| 4,247,032 | 1/1981 | Stanik | 227/32 X |
| 4,376,504 | 3/1983 | Birkhofer | 227/32 |
| 4,452,467 | 6/1984 | Hetzelt et al. | 280/615 |
| 4,552,297 | 11/1985 | Belanger et al. | 227/155 X |
| 4,703,882 | 11/1987 | Herten | 227/8 |
| 4,853,115 | 8/1989 | Kennel et al. | 74/50 X |
| 5,048,741 | 9/1991 | Toishi et al. . | |
| 5,263,627 | 11/1993 | Breuer et al. | 29/243.53 X |
| 5,269,451 | 12/1993 | Udagawa et al. | 227/155 X |

FOREIGN PATENT DOCUMENTS

| | | |
|---|---|---|
| 2533020 | 1/1977 | Germany . |
| 2651227 | 5/1977 | Germany . |
| 4225264 | 7/1993 | Germany . |
| 368581 | 3/1932 | United Kingdom . |
| 1051361 | 12/1966 | United Kingdom . |
| 9312680 | 7/1993 | WIPO . |

OTHER PUBLICATIONS

Lueger Lexikon der Technik, vol. 1, pp. 275–278 and 280–282.

*Primary Examiner*—Charles A. Marmor
*Assistant Examiner*—Troy Grabow
*Attorney, Agent, or Firm*—Robert W. Becker & Associates

[57] ABSTRACT

The feeding device for feeding parts to be mounted to at least one of an upper tool and a lower tool of a mounting machine has a carriage and at least one feeding push rod connected to the carriage. A push crank is connected to the carriage for moving in a reciprocating movement the at least one feeding push rod in a longitudinal direction of the at least one push rod between an extended and a retracted position.

17 Claims, 3 Drawing Sheets

FEEDING DEVICE FOR PARTS TO BE MOUNTED

BACKGROUND OF THE INVENTION

The present invention relates to a device for feeding parts to be mounted to at least one upper or lower tool of a mounting machine for machining or further processing the parts to be mounted whereby the upper and lower tools are movable relative to one another between a working position and a rest position and the parts to be mounted are fed to the respective tool via a feed channel with the aid of a push rod.

Such devices for feeding parts to be mounted are known in general. They are especially used in connection with machines for mounting rivets, snap closures, etc. For example, a device of the aforementioned kind for feeding parts to be mounted is known from German Offenlegungsschrift 42 25 264. According to this disclosure, a spring-loaded lever with a projecting part is arranged at a feed path located at a lift-controlled upper tool and is forced by a downward movement of the upper stamp against the spring force into a rearward position. This movement entrains a carriage into a retracted position. The carriage has connected thereto push rods. When the lift-controlled upper stamp is moved into its upper position, the lever due to the spring loading is pulled into a forward position and moves the carriage also into a forward position. The push rods then impact the parts to be mounted, located within the feed channel, and guide them to the upper and/or lower tool, respectively, the holding device arranged thereat. In order to provide sufficient time for the insertion of parts to be mounted into the feed channels, the feed push rods are returned into a position that is far behind the location of introduction of the parts into the feed channel. Thus, due to the high return speed of the push rods a considerable impacting speed of the push rod onto the parts inserted occurs. Due to this impact the parts can be damaged in an undesirable manner and the device produces large amount of discard. Furthermore, the masses must travel a long distance within a very short period of time so that a large amount of energy is required for operating the device. For example, if it is desired to shorten the travel path with a corresponding arrangement of the push rod, the insertion time is automatically shortened. Furthermore, a large number of components must be positioned relative to one another, aligned, and adjusted. Also, there is no option for controlling or simply varying of the insertion time. Moreover, due to certain switch arrangements the feeding device is switched off when the forward movement of the push rod is obstructed. Due to the high acceleration forces, however, a considerable obstructing force is required to cause a switching off. Slightly deformed parts etc. will still be fed to the tools. An adjustment of this reaction force is also not possible.

Due to the masses being moved at high velocities, the known devices for feeding parts to be mounted require a considerable amount of maintenance and are subject to great wear.

It is therefore an object of the present invention to improve a device for feeding parts to be mounted of the aforementioned kind such that the construction is simplified and the servicing expenditure, the wear susceptibility, and the requirements for adjustment and alignment are reduced. Variability of the insertion time should also be provided with simple means.

SUMMARY OF THE INVENTION

A feeding device for feeding parts to be mounted to at least one of an upper tool and a lower tool of a mounting machine according to the present invention is primarily characterized by:

A carriage;

At least one feeding push rod connected to the carriage;

A push crank connected to the carriage for moving in a reciprocating movement the at least one feeding push rod in the longitudinal direction of the at least one push rod between an extended and a retracted position.

Advantageously, the push crank is a center push crank.

Advantageously, the carriage is positioned at a first point of reversal when the at least one push rod is in the extended position and positioned at a second point of reversal when the push rod is in the retracted position. The push crank and the carriage are positioned in parallel planes. The push crank is located between the first and second points of reversal.

Expediently, the push crank comprises a roller describing a circle upon rotation of the push crank. The carriage comprises a curved guide slot and the roller is positioned and guided in the curved guide slot. The curved guide slot has a distance between the ends of the slot in a direction transverse to a direction of reciprocation that is at least as long as a diameter of the circle described by the roller.

In a preferred embodiment of the present invention the curved guide slot is arc-shaped and has a constant radius.

Advantageously, the radius allows a rolling of the roller in the curved guide slot, when the carriage is positioned at one of the first and second points of reversal, without transmittal of pushing forces. Preferably, the roller rolls without force transmittal in the curved guide slot when the carriage is positioned at the second point of reversal.

Preferably, the length of the radius is adjustable.

Advantageously, the push crank is a disk.

In another embodiment of the present invention the feeding device further comprises a gear disk to which the push crank is connected.

Expediently, the carriage is a slide.

Advantageously, the feeding device comprises two of the feeding push rods.

Expediently, the carriage comprises a guide for the at least one feeding push rod.

Preferably, the guide comprises a catch connection for arresting the at least one feeding push rod in the guide.

Preferably, the catch connection comprises a spring-loaded arresting cam. Advantageously, the at least one feeding push rod comprises an arresting groove for engaging the arresting cam.

Preferably, the carriage comprises a switching abutment for switching a control switch. The feeding device preferably further comprises at least one lock switch for partially interrupting the supply of parts to be mounted, wherein the switching abutment activates the lock switch. Expediently, the feeding device comprises a plurality of such lock switches one of which is selectable for partially interrupting the supply.

According to the present invention the feeding push rod is arranged at a carriage which can be reciprocated in the longitudinal direction of the feeding push rod by a push crank.

With the inventive embodiment the movement of the feeding push rod is made independent of the movement of the tools so that possibilities for variations of the movement are improved. For example, the feeding path can be reduced by arranging a corresponding push crank such that the impact velocity of the push rod for impacting the parts (articles) positioned in the feed channel is reduced. Furthermore, it is no longer required to move a great mass at high velocities to that the energy requirements are considerably lowered. Furthermore, the servicing and adjustment expenditure is substantially reduced.

According to an advantageous embodiment of the invention it is suggested that the carriage is reciprocatable with a center push crank (i.e., a rotary crank with a central axis of rotation). The central arrangement of the push crank avoids the use of unreliable linking rods that have to be aligned. In an advantageous manner the central push crank is arranged in a plane parallel to the carriage so as to be located between the forward and rearward points of reversal of the carriage. In an especially advantageous manner the connection between the push crank and the carriage is in the form of a roller arranged at the push crank which is guided within a guide slot provided at the carriage. The distance between the ends of the guide slot corresponds to the diameter of the circle described by the roller. Such push cranks are also known as cross push cranks which in the case of the present invention are combined with a curve in the form of a catch gear drive. This arrangement is also known as a cross push crank with catch. With this simple embodiment the number of components movable relative to one another is considerably reduced. Furthermore, a plurality of rotatable components can be used which, in general, allow for better adjustment and control possibilities, provide good force transmission, and, in general, are service-free. In an advantageous manner the curved (arc-shaped) guide slot has a constant radius. According to one particular suggestion of the present invention the radius of the curved guide slot is such that the roller is guided within the curved guide slot without push force transmission in one of the reversing positions over an angular range $\phi$. With this measure it is possible to determine the time of rest of the carriage at one of the two reversing positions. Advantageously, the center point of the radius of the curved guide slot is positioned between the guide slot and the push rods so that a rest period results in the rearward reversing position. The length of the radius is advantageously adjustable. For example, this can be effected by adjustable sliding blocks.

In an advantageous manner the push crank is a disk that, according to another suggestion of the present invention, is driven by a drive wheel of the drive unit of the mounting machine. According to another aspect of the present invention the carriage is in the form of a slide which advantageously carries two of the aforementioned feeding push rods. Thus, with a forward movement the upper as well as the lower tool can be supplied with parts to be mounted. Advantageously, the feeding push rods are inserted into guides provided at the carriage. This allows for an easy adjustability and exchangeability. Advantageously it is suggested that the feeding push rods within the guides are arranged with the aid of catch connections. In addition to the easy exchangability and adjustability, the feeding push rods can be pushed into the guides with the aid of the catch connections when an obstacle is encountered. The destruction of machine parts due to the presence of defective parts to be mounted is thus reduced with this catch arrangement. Advantageously, the catch connection is in the form of a spring-loaded catch cam. The arresting cam rests according to another suggestion of the present invention in an arresting groove. Thus, the feeding push rod is provided with an excellent feeding push rod guidance as well as with a safety release.

According to another advantageous embodiment of the present invention, the carriage is provided with a switch abutment with which in the one of the reversing positions a control switch is actuated. This switching abutment actuates, for example, a lock switch for partially blocking mounting (i.e., interrupting the supply to the feed channel), whereby, according to a suggestion of the present invention, one of a plurality of such lock switches can be selected. When the carriage reaches its rearward position the control switch is closed and one of a plurality of the lock switches is selected and opened. The part to be mounted is released and inserted into the feed channel and, subsequently, when the carriage is moved toward the forward position, the feeding push rod feeds the part to be mounted to the tools.

The simple control of the carriage, which has connected thereto the feeding push rods, via a push crank reduces the energy, mounting, adjusting and servicing expenditures of a feeding device for feeding parts to be mounted to a mounting machine and furthermore reduces the velocity with which the feeding push rod impacts the parts to be mounted. It is thus possible without any problems to control the carriage such that the feeding push rod reaches a rearward reversing position (i.e., the retracted position) directly behind the location of insertion of the parts to be mounted into the feed channel. The impacting velocity is thus almost zero. The resting period which is required for insertion of the parts into the feed channel can be realized easily by designing the guide slot at the carriage with a corresponding radius. The speeds of the movements can thus be reduced due to the shortened path of the parts to be moved.

BRIEF DESCRIPTION OF THE DRAWINGS

The object and advantages of the present invention will appear more clearly from the following specification in conjunction with the accompanying drawings, in which.

DESCRIPTION OF PREFERRED EMBODIMENTS

The present invention will now be described in detail with the aid of several specific embodiments utilizing FIGS. 1 through 3.

Figure 1:
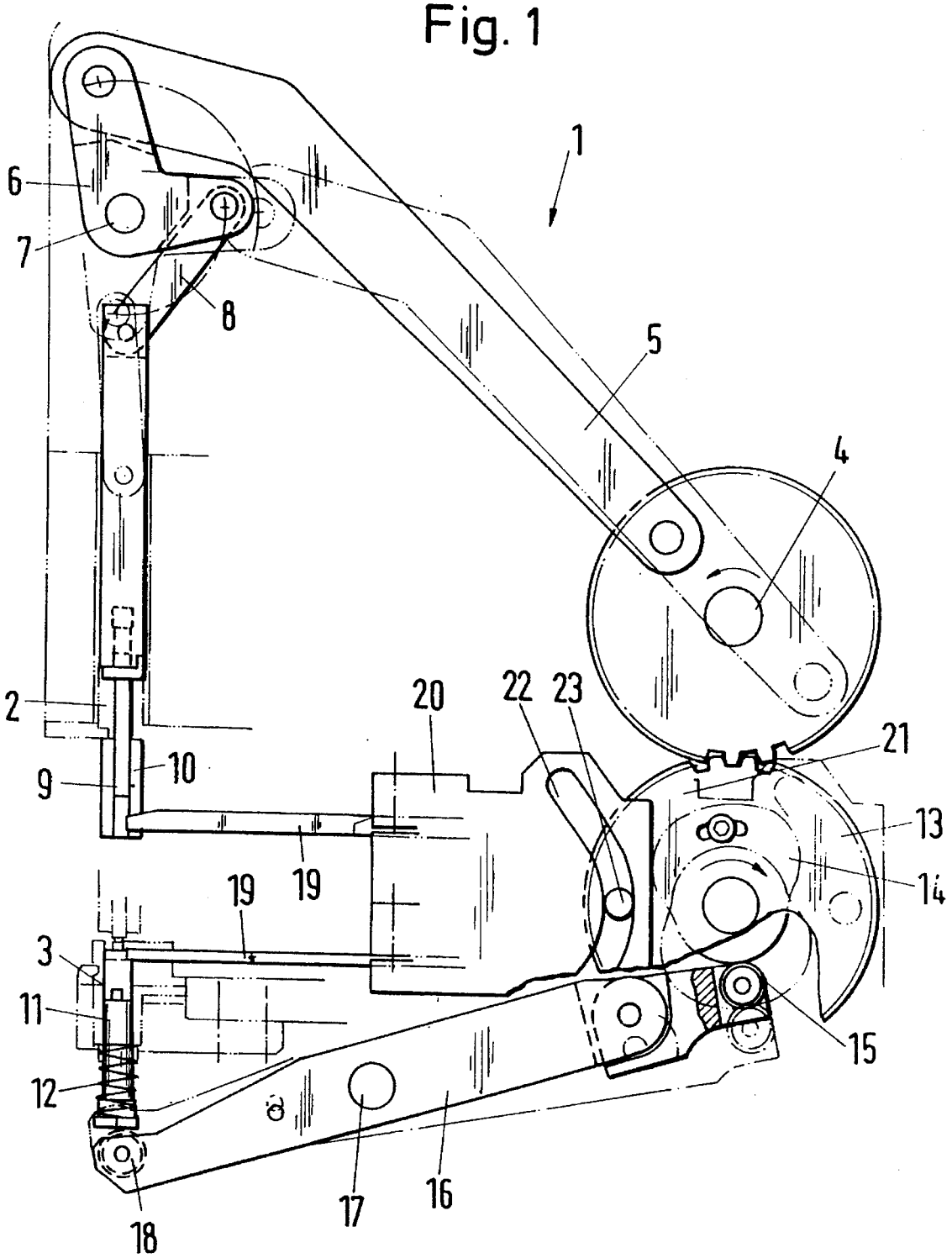
FIG. 1 is a schematic representation of a mounting machine for mounting rivets, snap closures, etc.

The schematic representation of a mounting machine for mounting rivets, snap closures, patent closures, etc. represented in FIG. 1 shows the arrangement of a device for feeding the parts to be mounted to the mounting machine. The mounting machine 1 comprises an upper tool 2 and a lower tool 3 as well as a drive unit 4. With the drive unit 4 the coupling member 5 for the upper tool 2 is driven, and the upper stamp 9 is reciprocated vertically by a lever 6, rotating about an axle 7, a connecting arm 8, and a push rod. In the area of the upper stamp 9 a holding tool 10 is arranged. The lower stamp or anvil 11 which is prestressed by a spring 12 into a retracted position is also lift-controlled via a drive disk 13 that is connected to a curve disk 14 and a lever 16. A roller 15 is connected to the lever 16 and cooperates with the curved disk 14 so that the lever 16 carries out pivoting movements about the axle 17 which pivoting movements are transmitted via the roller 18 onto the lower stamp 11. Feeding push rods 19 are arranged at a carriage 20 and reciprocated with the aid of a push crank 21. For this purpose, a roller 23 is arranged at the push crank 21 which is guided in a curved slot 22 of the carriage 20.

Figure 2:
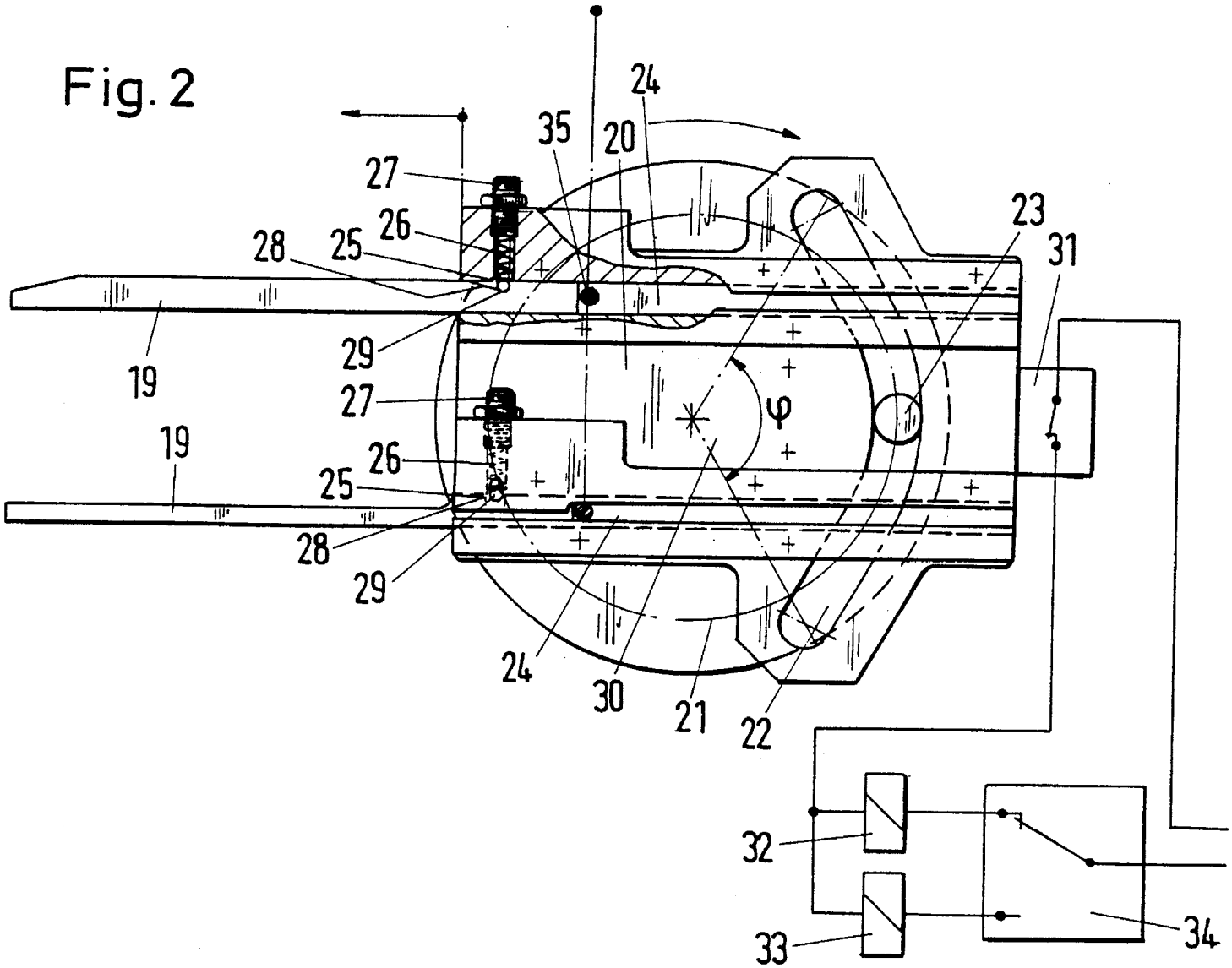
FIG. 2 shows a schematic representation of one embodiment of a feeding device with the carriage at the rearward point of reversal.
Figure 3:
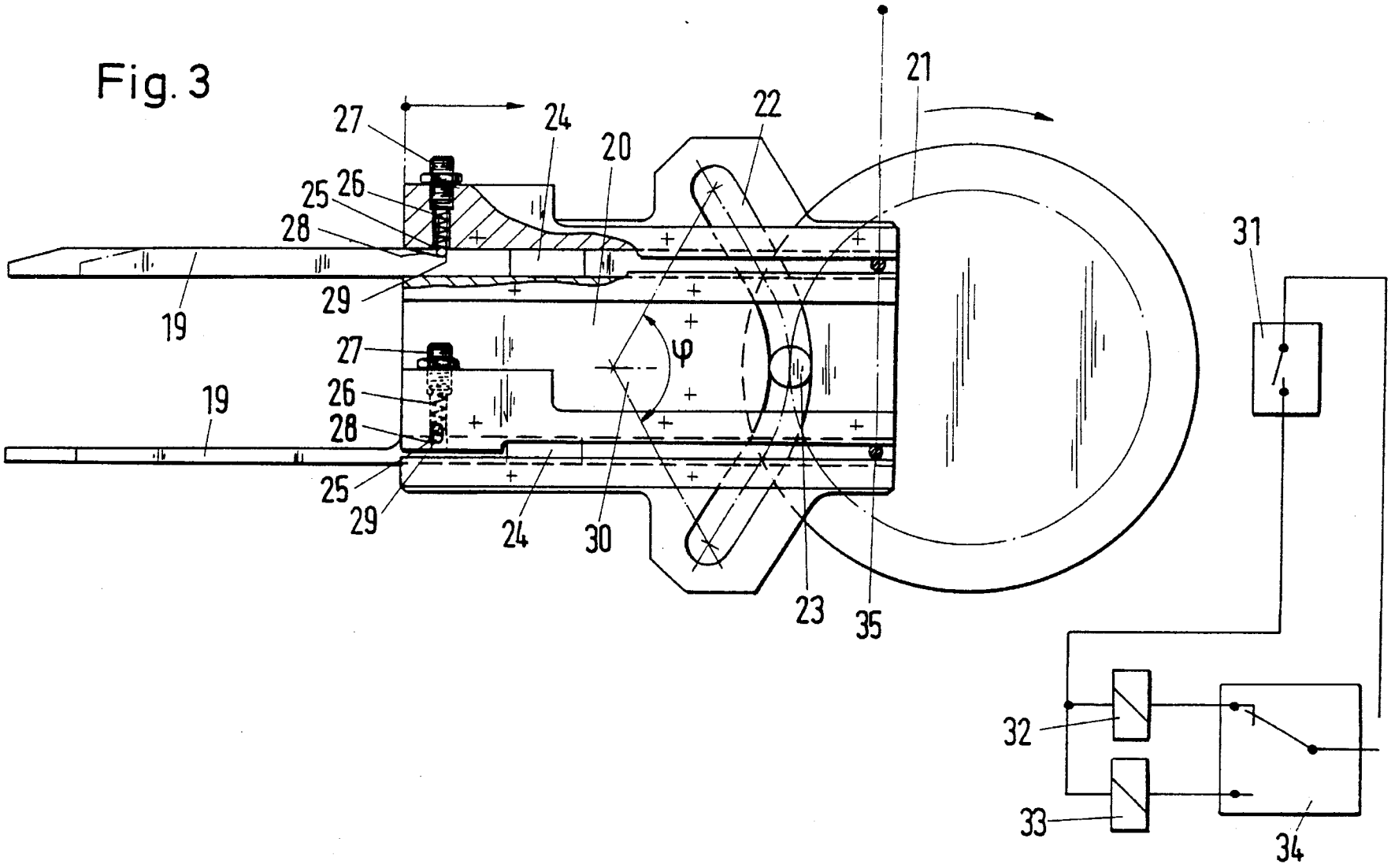
FIG. 3 shows a representation according to FIG. 2 with the carriage at the forward point of reversal.

As shown in FIGS. 2 and 3, the guide slot 22 has an adjustable radius so that within an angular range $\phi$ which is adjustable practically no force transmission between the roller 23 and the carriage 20 takes place. Thus, a resting period is defined in which the carriage 20 remains at the rearward point of reversal without forward movement. The resting period can be used for inserting parts to be mounted into the non-represented feed channel(s). The carriage 20 in the shown embodiment is provided with two push rod guides 24 into which the feeding push rods 19 are inserted. For this purpose, arresting cams 25 project into the push rod guides 24. In the shown embodiment the arresting cams 25 are spring-loaded by springs 26 and adjustable with an adjusting bolt 27 with regard to their prestress, respectively, penetration depth. The feeding push rods 19 are provided with respective arresting grooves 28. In the shown embodiment the arresting cams are formed by members such as cylinder rollers, fitting pins or balls 29 at the lower end of the adjusting bolts 27 which members engage the arresting grooves 28 of the feeding push rods 19. When a certain force is generated at the forward edge of the feeding push rods 19, the feeding push rods 19 are forced into the push rod guides 24. Due to the arrangement of stops 35 it is ensured that the feeding push rods 19 can be returned into the arrested position when the carriage 20 is moved to the rearward point of reversal (retracted position of the push rods or rearward reversing position of the carriage).

When the carriage 20 reaches the rearward point of reversal, it abuts the control switch 31 and closes a circuit. One of the lock switches 32 or 33 opens (they are selectable by the selection switch 34) and releases an article (part to be mounted) which is introduced into the feed channel. During this time the carriage 20 remains in the rearward position and the roller 23 moves without transferring advancing forces through the guide slot 22. Upon reaching the respective end point of the guide slot, the roller 23, which is driven by the central push crank 21, transmits advancing forces onto the carriage 20 and moves it toward the forward point of reversal (forward reversing position of the carraige or the extended position of the push rods). The feeding push rods 19, which are retracted only to a position shortly behind the insertion location into the feed channel when the carriage 20 is in its rearward reversing position, essentially impact and entrain the inserted article at the beginning of the forward movement. Thus, when impacting the article the speed of the push rods is very low since the feeding push rod 19 does not travel along an acceleration path.

The carriage 20 is advantageously provided in the form of a plate comprising the guide slot. It is provided with respective push rod guides by connecting thereto substantially angular pieces. For both push rod guides substantially the same parts can be used.

The present invention is, of course, in no way restricted to the specific disclosure of the specification and drawings, but also encompasses any modifications within the scope of the appended claims.

What we claim is:

1. A feeding device for feeding parts to be mounted to at least one of an upper tool and a lower tool of a mounting machine, said feeding device comprising:

a carriage;

at least one feeding push rod connected to said carriage;

a center push crank, connected to said carriage, for moving in a reciprocating movement said carriage in a longitudinal direction of said at least one push rod to thereby move said at least one feeding push rod between an extended and a retracted position;

wherein said center push crank comprises a roller;

wherein said carriage comprises a curved guide slot; and wherein said roller is positioned and guided in said curved guide slot.

2. A feeding device according to claim 1, wherein:

said carriage is positioned at a first point of reversal of said reciprocating movement when said at least one push rod is in said extended position and positioned at a second point of reversal of said reciprocating movement when said at least one push rod is in said retracted position;

said push crank and said carriage are arranged in parallel planes; and said push crank is located between said first and said second points of reversal of said carriage.

3. A feeding device according to claim 1, wherein:

said roller describes a circle upon rotation of said push crank; and said curved guide slot has a distance between the ends of the slot in a direction transverse to said reciprocating movement that is at least as long as a diameter of said circle described by said roller.

4. A feeding device according to claim 3, wherein said curved guide slot is arc-shaped and has a constant radius.

5. A feeding device according to claim 4, wherein said radius allows said roller, when said carriage is positioned at one of said first and second points of reversal, to roll without transmittal of pushing forces within said guide slot.

6. A feeding device according to claim 5, wherein said roller rolls without transmittal of pushing forces in said curved guide slot when said carriage is positioned at said second point of reversal.

7. A feeding device according to claim 1, wherein said push crank is a disk.

8. A feeding device according to claim 7, further comprising a gear disk to which said push crank is connected.

9. A feeding device according to claim 1, wherein said carriage is a slide.

10. A feeding device according to claim 1, comprising two of said feeding push rods.

11. A feeding device according to claim 1, wherein said carriage comprises a guide for said at least one feeding push rod.

12. A feeding device according to claim 11, wherein said guide comprises a catch connection for arresting said at least one feeding push rod in said guide.

13. A feeding device according to claim 12, wherein said catch connection comprises a spring-loaded arresting cam.

14. A feeding device according to claim 13, wherein said at least one feeding push rod comprises an arresting groove for engaging said arresting cam.

15. A feeding device according to claim 1, wherein said carriage comprises a switching abutment for switching a control switch.

16. A feeding device according to claim 15, further comprising at least one lock switch for partially interrupting the supply of parts to be mounted, wherein said switching abutment activates said lock switch.

17. A feeding device according to claim 16, comprising a plurality of said switches one of which is selectable for partially interrupting the supply of parts.

* * * * *